US011585342B2

(12) United States Patent
Brandolin et al.

(10) Patent No.: US 11,585,342 B2
(45) Date of Patent: Feb. 21, 2023

(54) PRIMARY VACUUM PUMP OF DRY TYPE AND METHOD FOR CONTROLLING THE INJECTION OF A PURGE GAS

(71) Applicant: PFEIFFER VACUUM, Annecy (FR)

(72) Inventors: Serge Brandolin, Boussy (FR); Eric Mandallaz, Annecy (FR)

(73) Assignee: PFEIFFER VACUUM, Annecy (FR)

( * ) Notice: Subject to any disclaimer, the term of this patent is extended or adjusted under 35 U.S.C. 154(b) by 256 days.

(21) Appl. No.: 16/583,318

(22) Filed: Sep. 26, 2019

(65) Prior Publication Data

US 2020/0102960 A1 Apr. 2, 2020

(30) Foreign Application Priority Data

Sep. 27, 2018 (FR) ..... 18 58887

(51) Int. Cl.

| | |
|---|---|
| ***F04C 28/24*** | (2006.01) |
| ***B08B 9/032*** | (2006.01) |
| ***F04C 29/00*** | (2006.01) |

(52) U.S. Cl.

CPC ..... *F04C 29/0014* (2013.01); *B08B 9/0321* (2013.01); *F04C 28/24* (2013.01);

(Continued)

(58) Field of Classification Search

CPC .... F04C 18/126; F04C 25/02; F04C 29/0014; F04C 29/0092; F04C 18/123;

(Continued)

(56) References Cited

U.S. PATENT DOCUMENTS 4,995,794 A * 2/1991 Wycliffe ..... F04C 25/02 417/423.2

6,421,127 B1 7/2002 McAndrew et al.

(Continued)

FOREIGN PATENT DOCUMENTS

| | | |
|---|---|---|
| CN | 104541061 B | 2/2017 |
| GB | 2500610 A | 10/2013 |
| WO | WO 2014/012896 A2 | 1/2014 |

OTHER PUBLICATIONS

French Preliminary Search Report dated May 21, 2019 in French Application 18 58887, filed on Sep. 27, 2018 (with English Translation of categories of Cited Documents & Written Opinion).

(Continued)

*Primary Examiner* — Dominick L Plakkoottam

(74) *Attorney, Agent, or Firm* — Oblon, McClelland, Maier & Neustadt, L.L.P.

(57) ABSTRACT

A dry type primary vacuum pump is provided, including at least two pumping stages mounted in series between a suction and a discharge of the pump; two rotors extending in the pumping stages and being configured to rotate synchronously in a reverse direction to drive a gas to be pumped between the suction and the discharge; an injection device configured to distribute a purge gas in at least one pumping stage, the injection device including at least one injector and at least one injection valve with an on or off control configured to be interposed between a purge gas supply source and the injector; and a control device configured to control opening and closing of the injection valve to inject a purge gas by successive pulses into the at least one pumping stage. A method for controlling the injection of a purge gas the vacuum pump is also provided.

10 Claims, 3 Drawing Sheets

(52) U.S. Cl.
CPC ..... *F04C 29/0092* (2013.01); *F04C 2220/12* (2013.01); *F04C 2270/585* (2013.01)

(58) Field of Classification Search
CPC .. F04C 2220/12; F04C 2280/02; F04C 18/16; F04C 2270/585; F04C 25/00; F04C 28/28
See application file for complete search history.

(56) References Cited

U.S. PATENT DOCUMENTS

| | | | | |
|---|---|---|---|---|
| 7,819,646 | B2 * | 10/2010 | Hope | F04C 29/0014 418/201.1 |
| 8,047,817 | B2 * | 11/2011 | Manson | F04C 28/28 417/431 |
| 2006/0032442 | A1 | 2/2006 | Hasebe | |
| 2014/0205482 | A1 * | 7/2014 | Crochet | F04C 28/065 418/5 |
| 2015/0170938 | A1 * | 6/2015 | Seigeot | F04F 5/20 137/240 |

OTHER PUBLICATIONS

Office Action dated Jul. 22, 2022, issued in corresponding Chinese patent application No. 201910911235.9 (with English translation).
Office Action dated Dec. 7, 2022 in corresponding Taiwanese Patent Application No. 108125580 (with English translation)(12 pages).

* cited by examiner

PRIMARY VACUUM PUMP OF DRY TYPE AND METHOD FOR CONTROLLING THE INJECTION OF A PURGE GAS

The present invention relates to a primary vacuum pump of dry type such as of "Roots" or "Claw" or screw type. The present invention also relates to a method for controlling the injection of a purge gas in such a vacuum pump.

The primary vacuum pumps of dry type comprise several pumping stages in series in which a gas to be pumped between a suction and a discharge circulates. Among the known primary vacuum pumps, there are those with rotary lobes, also known as "Roots" pumps or those with a beak, also known as "Claw" pumps or even those with a screw. These vacuum pumps are called "dry" because, in operation, the rotors rotate inside a stator with no mechanical contact between them or with the stator, which makes it possible to not use oil in the pumping stages.

Some primary vacuum pumps are employed in methods using chemistries generating solid by-products, for example, in the form of powder, paste or pieces. Such is the case, for example, with certain methods for manufacturing semiconductors, photovoltaic screens, flat screens or LEDs. These solid by-products can be sucked by the vacuum pump and can affect its operation, particularly by hampering the rotation of the rotors, even by totally preventing it in the worst case situation.

To avoid that, several solutions are already known.

For example, the vacuum pumps are protected by installing powder traps at the pump inlet. These traps are, for example, composed of powder separators which retain the solid compounds by gravity or by centrifugal force.

Another method that is employed consists of adapting the geometry of the vacuum pump to facilitate the evacuation of the solid by-products, for example, by increasing the diameter of the transfer channels or by arranging the pumping stages vertically.

Also, injecting a purge gas into the vacuum pump participates in the evacuation of the solid by-products in addition to diluting the gases pumped. For that, nitrogen or air is generally injected through injection nozzles distributed along the vacuum pump, at each pumping stage. This purge gas can participate in the pneumatic transporting of the solid powders.

However, in some cases, these solutions can be inadequate because the nature of the solid by-products can allow the latter to adhere strongly to the walls and it is then more difficult to evacuate them.

One aim of the present invention is to at least partially resolve an abovementioned drawback of the state of the art.

To this end, the subject of the invention is a primary vacuum pump of dry type comprising:

- at least two pumping stages mounted in series between a suction and a discharge of the vacuum pump,
- two rotors extending in the pumping stages, the rotors being configured to rotate synchronously in reverse direction to drive a gas to be pumped between the suction and the discharge,
- an injection device configured to distribute a purge gas in at least one pumping stage, comprising:
  - at least one injection member, and
  - at least one injection valve with on or off control intended to be interposed between a purge gas supply source and the at least one injection member,
  - characterised in that the vacuum pump further comprises a control device configured to control the opening and the closing of the at least one injection valve to inject a purge gas by successive pulses into at least one pumping stage.

The opening/closing control of the at least one injection valve makes it possible to pulse the injection of the purge gas alternating phases of injection (or pulses) with phases without injection or with lesser flow injection.

This pulsed flow injection mode, that is to say by a train of pulses, makes it possible to create wave fronts at the moment of injection allowing for a detachment of the solid by-products which is more effective than a continuous injection of purge gas.

Furthermore, the pulsed flow injection of the purge gas makes it possible to be able to maintain a mean value of the injected purge gas flow of the same order of magnitude as that of a conventional, continuous injection of purge gas.

The on or off control of the at least one injection valve makes it possible to produce control pulses that make it possible to ensure an injection by successive pulses with rising edges exhibiting steep slopes which are more effective for the detachment of the solid by-products. The slope of the rising edge of the purge gas flow on a pulse is, for example, greater than 100 slm/s.

The injection member, such as a gauged orifice (also called spray nozzle), an injection nozzle or such as a flow (or "mass flow") controller, is configured to limit the flow of the purge gas in the pumping stage, for example, to a value lower than 200 slm (or 338 $Pa \cdot m^3/s$).

The at least one controllable injection valve is, for example, a solenoid valve such as an electromagnetic or piezoelectric solenoid valve. This valve has an on or off control: it is either open, or closed.

The frequency and the duration of the pulses can be adjusted depending on the nature of the by-products to be evacuated. It is thus possible to space out or to multiply the number of pulses depending on the effect sought.

The frequency (rate of openings/closures), the duration, the duty cycle (opening time/closing time) and the amplitudes of the purge gas pulses can be parameters that can be set by the user by means of an interface of the control device.

The purge gas flow injected by pulses lies, for example, between 10 slm (or 17 $Pa \cdot m^3/s$) and 120 slm (or 202 $Pa \cdot m^3/s$), such as 100 slm (or 169 $Pa \cdot m^3/s$).

The frequency of the pulses lies, for example, between 0.1 Hz and 5 Hz, such as 0.5 Hz, that is to say an opening every two seconds.

The duty cycle can lie between 1 and 80%. It is, for example, 50%.

The opening time/closing time of the injection valve lies, for example, between 1 and 80%, such as between 40 and 80%.

The duration of a purge gas injection pulse is, for example, of the order of a second and the closure time of the injection valve is, for example, of the order of one second.

According to an exemplary embodiment, the injection device comprises:

- a distribution manifold configured to distribute a purge gas in the pumping stages,
- an injection member for each pumping stage interposed between the distribution manifold and a respective pumping stage.

According to an exemplary embodiment, the injection valve is arranged on a branch of the distribution manifold common to the pumping stages.

According to an exemplary embodiment, the injection device comprises an injection valve for each pumping stage arranged on a respective bypass of the distribution manifold suitable for distributing a purge gas in a respective pumping stage.

According to an exemplary embodiment, the vacuum pump further comprises an additional injection device comprising:

- a distribution manifold for distributing a purge gas in the pumping stages,
- an injection member for each pumping stage interposed between the distribution manifold and a respective pumping stage,
- a controllable continuous injection valve arranged on a branch of the distribution manifold common to the pumping stages, the control device also being configured to control the opening of the at least one continuous injection valve to inject a purge gas continuously into the pumping stages.

Another subject of the invention is a method for controlling the injection of a purge gas into a primary vacuum pump of dry type as described previously, characterised in that the opening of the at least one injection valve is controlled to inject a purge gas by successive pulses into at least one pumping stage.

According to an exemplary embodiment of the control method, at least two purge gas pulse durations are different in two pumping stages.

According to an exemplary embodiment of the control method, a continuous flow of purge gas is also injected into at least one pumping stage by controlling at least one injection valve continually in open mode.

According to an exemplary embodiment of the control method, the opening of the at least one continuous injection valve is also controlled to inject a purge gas continuously at each pumping stage.

According to an exemplary embodiment of the control method, the control of the injection valves is synchronised to stagger the injection of the purge gas pulses into at least two pumping stages.

According to an exemplary embodiment of the control method, the staggering of the purge gas pulses is synchronised to open the injection valves in the pumping stages successively in the direction of flow of the gases going from the suction to the discharge of the vacuum pump.

According to another exemplary embodiment of the control method, the staggering of the purge gas pulses is synchronised to open the injection valves in the pumping stages successively in the direction of flow of the gases going from the discharge to the suction of the vacuum pump. Thus, a gaseous wave front is artificially created that moves in the direction counter to the flow of the pumped gases making it possible to evacuate the by-products gradually, by beginning with the last, then the second last and so on which makes it possible to avoid the build-up thereof between the pumping stages or in a silencer generally arranged after the discharge.

Other advantages and features will appear on reading the description of the invention, and the attached drawings in which.

In these figures, the elements that are identical bear the same reference numbers. The drawings are simplified to simplify the understanding thereof.

The following embodiments are examples. Although the description refers to one or more embodiments, that does not necessarily mean that each reference relates to the same embodiment, or that the features apply only to a single embodiment. Simple features of different embodiments can also be combined or interchanged to provide other embodiments.

A primary vacuum pump is defined as a volumetric vacuum pump, which sucks, transfers then discharges a gas to be pumped. In conventional use, a primary vacuum pump is configured to be able to discharge a gas to be pumped at ambient pressure.

Figure 1:
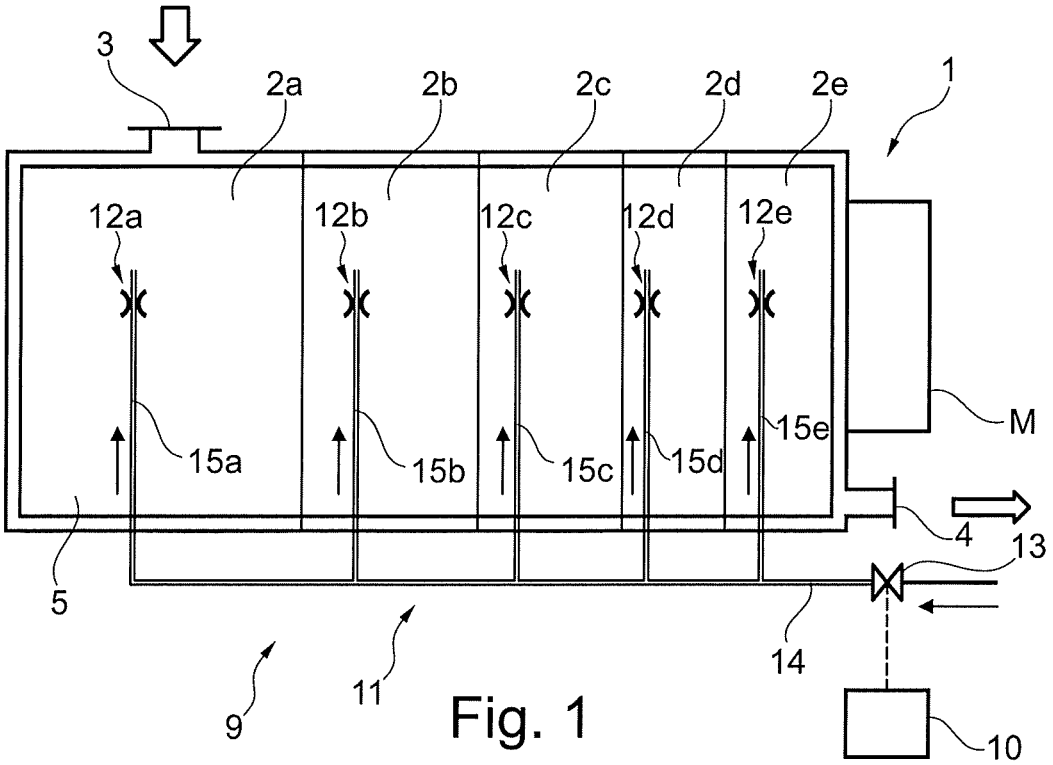
FIG. 1 shows a very schematic view of a first exemplary embodiment of a primary vacuum pump of dry type.

FIG. 1 represents a first exemplary embodiment of a primary vacuum pump 1 of dry type.

The vacuum pump 1 comprises at least two pumping stages 2*a*-2*e* mounted in series between a suction 3 and a discharge 4 and in which a gas to be pumped can circulate (the direction of circulation of the pumped gases is illustrated by the arrows in FIG. 1).

In the illustrative example, the vacuum pump 1 comprises five pumping stages 2*a*, 2*b*, 2*c*, 2*d*, 2*e*. Each pumping stage 2*a*-2*e* comprises a respective inlet and outlet. The successive pumping stages 2*a*-2*e* are coupled in series one after the other by respective inter-stage channels coupling the output of the preceding pumping stage to the inlet of the next stage.

The vacuum pump 1 further comprises two rotors 5 extending in the pumping stages 2*a*-2*e*.

The rotors 5 have, for example, lobes of identical profiles that are staggered angularly, for example, of "Roots" type, for example, with a section in the form of an "eight" or of a "bean", or of "Claw" type or of screw type or based on another similar principle of volumetric vacuum pump.

The rotors 5 are configured to rotate synchronously in reverse direction to drive a gas to be pumped between the suction 3 and the discharge 4 of the vacuum pump 1.

During the rotation, the gas sucked from the inlet is trapped in the volume generated by the rotors 5 and a stator of the pumping stage 2*a*-2*e*, then is driven by the rotors 5 to the next stage.

The rotors 5 are driven in rotation by a motor M of the vacuum pump 1.

The vacuum pump 1 further comprises an injection device 9 configured to distribute a purge gas, such as an inert gas, such as air or nitrogen, into at least one pumping stage 2*a*-2*e* and a control device 10 configured to control the injection device 9.

The injection device 9 comprises at least one injection member 12*a*-12*e* and at least one controllable injection valve 13.

The injection member 12*a*-12*e*, such as a gauged orifice (also called spray nozzle), an injection nozzle or such as a flow rate (or "mass flow") controller, is configured to limit the flow rate of the purge gas in the pumping stage 2*a*-2*e*, for example, to a value lower than 200 slm (or 338 $Pa \cdot m^3/s$).

The at least one controllable injection valve 13 is, for example, a solenoid valve, such as an electromagnetic or piezoelectric solenoid valve. This valve has an on or off control: it is either open, or closed. These valves offer the advantage of being simple, not bulky and inexpensive. The at least one injection valve 13 is interposed between a purge gas supply source and the at least one injection member 12*a*-12*e*.

Figure 2:
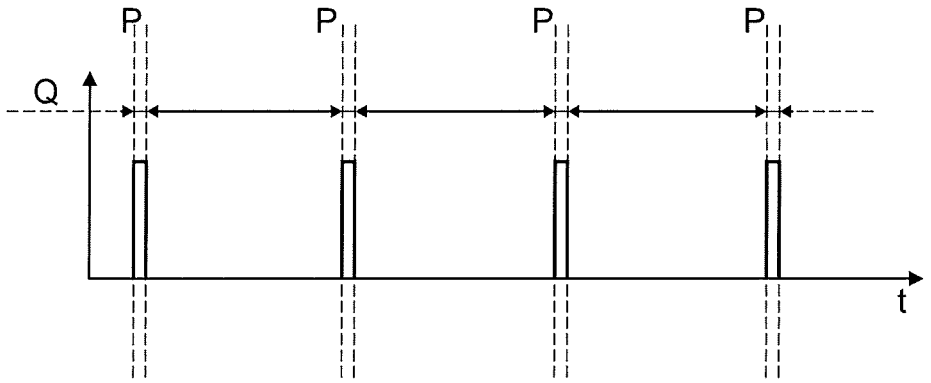
FIG. 2 shows a graph of purge gas pulses injected into a pumping stage of the vacuum pump of FIG. 1 as a function of time.

The control device 10 comprises one or more controllers or microcontrollers or processors and a memory to execute series of program instructions implementing a method for controlling the injection of a purge gas into the vacuum pump 1 in which the at least one injection valve 13 is controlled by opening and closing to inject a purge gas by successive pulses P into at least one pumping stage 2*a*-2*e* (FIG. 2).

The opening/closing control of the at least one injection valve 13 makes it possible to pulse the injection of the purge gas alternating phases of injection (or pulses) with phases without injection or with lesser flow injection.

This pulsed flow injection mode, that is to say by pulse train, makes it possible to create wave fronts at the moment of injection, allowing for a detachment of the solid by-products which is more effective than a continuous injection of purge gas.

Furthermore, the pulsed injection of the purge gas makes it possible to be able to maintain a mean value of the injected purge gas flow of the same order of magnitude as that of a conventional continuous injection of purge gas.

The on or off control of the at least one injection valve 13 makes it possible to produce control pulses that make it possible to ensure an injection by successive pulses with rising edges exhibiting strong slopes which are more effective for the detachment of the solid by-products. The slope of the rising edge of the purge gas flow on a pulse is, for example, greater than 100 slm/s.

The control device 10 is, for example, embedded in the vacuum pump 1.

The frequency and the duration of the pulses can be adjusted according to the nature of the by-products to be evacuated. It is thus possible to space out or to multiply the number of pulses depending on the effect sought.

The frequency (rate of openings/closures), the duration, the duty cycle (opening time/closing time) and the amplitudes of the purge gas pulses can be parameters that can be set by the user by means of an interface of the control device 10.

The purge gas flow injected by pulses lies, for example, between 10 slm (or 17 $Pa \cdot m^3/s$) and 120 slm (or 202 $Pa \cdot m^3/s$), such as 100 slm (or 169 $Pa \cdot m^3/s$).

The frequency of the pulses lies, for example, between 0.1 Hz and 5 Hz, such as 0.5 Hz, that is to say an opening every two seconds.

The duty cycle (the opening time/closing time of the injection valve) can lie between 1 and 80%, such as between 40 and 80%. It is, for example, 50%.

The duration of a purge gas injection pulse is, for example, of the order of a second and the closure time of the injection valve is, for example, of the order of a second.

According to a first exemplary embodiment represented in FIG. 1, the injection device 9 comprises a distribution manifold 11 (also called simply "manifold") configured to distribute a purge gas originating from the supply source in each of the pumping stages 2*a*-2*e* (the direction of circulation of the purge gas is illustrated by the arrows in FIG. 1).

For that, the distribution manifold 11 comprises a common branch 14 linked to bypasses 15*a*, 15*b*, 15*c*, 15*d*, 15*e*. The bypasses 15*a*-15*e* are suitable for distributing a purge gas in a respective pumping stage 2*a*-2*e*.

The injection valve 13 is arranged on a branch 14 of the distribution manifold 11 common to the pumping stages 2*a*-2*e*.

The injection device 9 further comprises an injection member 12*a*, 12*b*, 12*c*, 12*d*, 12*e* for each pumping stage 2*a*-2*e*. They are interposed between the distribution manifold 11 and a respective pumping stage 2*a*-2*e*.

In operation, the opening of the at least one injection valve 13 is controlled to inject purge gas by successive pulses into all the pumping stages 2*a*-2*e*.

This embodiment offers the advantage of being able to be implemented easily on existing vacuum pumps by simply modifying the control program of the at least one injection valve 13 of the injection device 9.

Given that the controllable injection valve 13 is common to all the pumping stages 2*a*-2*e*, the purge gas is injected by successive pulses into the pumping stages 2*a*-2*e* simultaneously and over a similar duration. Furthermore, between two purge gas pulses, the purge gas flow injected is nil since the at least one injection valve 13 has an on or off control.

In the case of injection members 12*a*-12*e* produced in the form of flow rate controllers that can be controlled by the control device 10, it is however possible to provide for particular pulse amplitudes on each pumping stage 2*a*-2*e*.

The distribution manifold 11 can also comprise at least one additional bypass configured to distribute a purge gas in a bearing of the vacuum pump 1 situated at an end of the rotors 5, for example between the motor M and the pumping stage 2*e* situated on the discharge side 4, here attached to the motor M.

Figure 3:
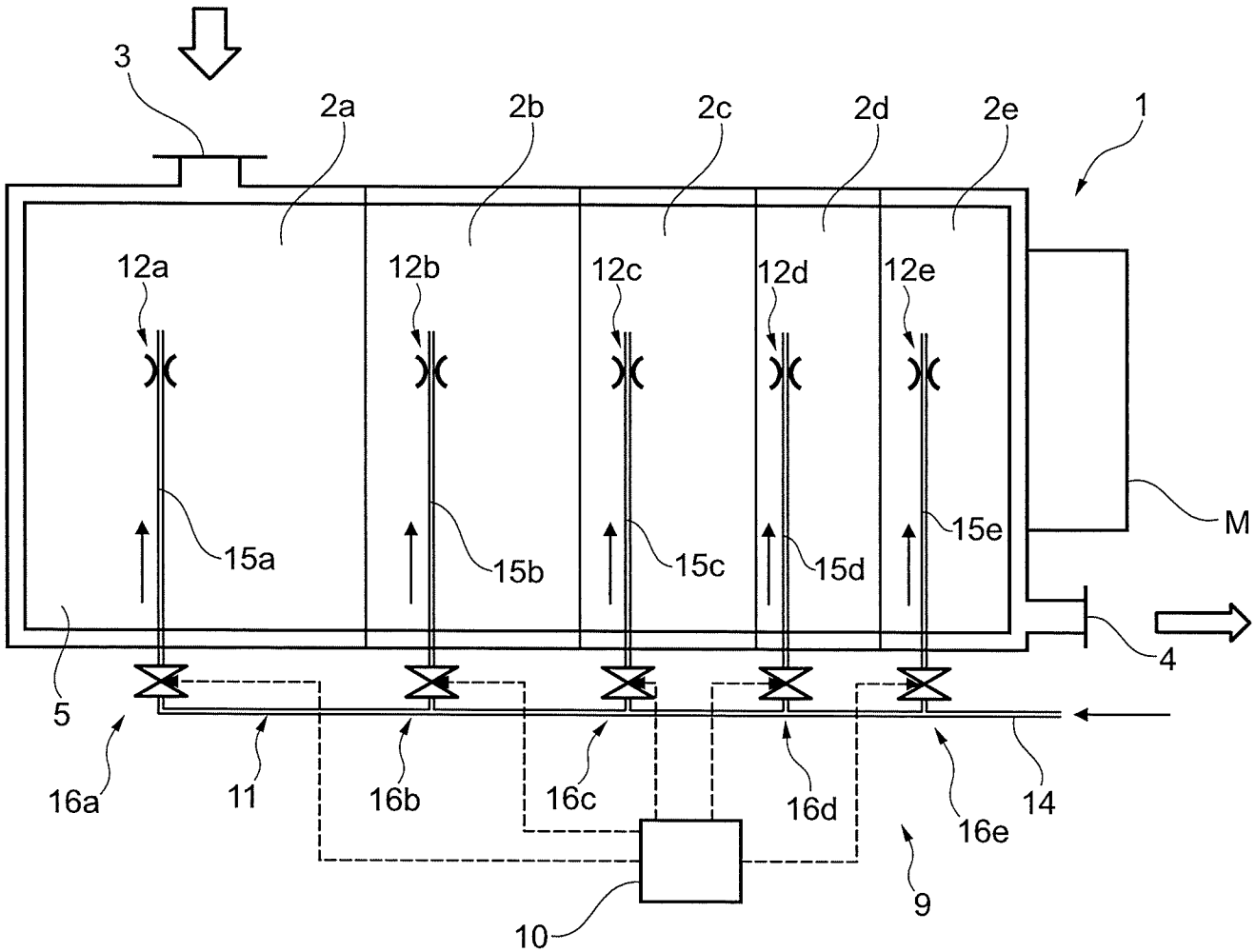
FIG. 3 shows a view similar to FIG. 1 for a second exemplary embodiment.

FIG. 3 shows a second exemplary embodiment.

This example differs from the preceding one in that the injection device 9 comprises an injection valve 16*a*-16*e* for each pumping stage 2*a*-2*e* arranged on a respective bypass 15*a*-15*e* of the distribution manifold 11.

In operation, the opening of the injection valves 16*a*-16*e* is controlled to inject purge gas pulses into at least one pumping stage 2*a*-2*e*.

It is possible in this example to independently control each injection valve 15*a*-15*b*. Thus, the purge gas pulses can be injected into one, several or all of the pumping stages 2*a*-2*e*, simultaneously or not.

It is also possible to provide for injecting a continuous flow of purge gas into the pumping stage or stages in which purge gas is not injected by successive pulses by controlling at least one injection valve 16*a*-16*e* continually in open mode. For example, a purge gas pulse is injected into the so-called low-pressure pumping stage 2*a* situated on the suction side 3 and a purge gas is injected continuously into the other pumping stages 2*b*-2*e*.

Moreover, the purge gas pulses can be injected over different or similar durations in the different pumping stages 2*a*-2*e*. Provision is, for example, made for at least two purge gas pulse durations to be different in two pumping stages 2*a*-2*e*. The frequencies of the pulses can therefore also be different for each pumping stage 2*a*-2*e*.

It is also possible to provide for the control of the injection valves 16*a*-16*e* to be synchronised to stagger the injection of the purge gas pulses in at least two pumping stages 2*a*-2*e*. In this case, the injection valves 16*a*-16*e* of at least two pumping stages 2*a*-2*e* are not open at the same time or the simultaneous opening times are relatively short compared to the total pulse duration.

For example, the staggering of the purge gas pulses is synchronised to open the injection valves 16*a*-16*e* in the pumping stages 2*a*-2*e* successively in the direction of flow of the gases going from the suction 3 to the discharge 4 of the vacuum pump 1. Thus, the injection valve 16*a* of the so-called low-pressure pumping stage 2*a* on the suction side 3 is first of all opened, then that associated with the second pumping stage 2*b* and so on to the so-called high-pressure pumping stage 2*e* on the discharge side 4. A gaseous wave front is thus artificially created that moves in the direction of flow of the pumped gases, improving the effectiveness of evacuation of the solid by-products.

According to another example, the staggering of the purge gas pulses is synchronised to open the injection valves 16*a*-16*e* in the pumping stages 2*a*-2*e* successively in the direction of flow of the gases going from the discharge 4 to the suction 3 of the vacuum pump 1.

Thus, for example, the regulation valve 16*e* arranged on the branch 15*e* coupled to the last pumping stage 2*e* is opened first of all, then, after its closure, the regulation valve 16*d* associated with the second last pumping stage 2*d* is opened, and so on, until the first or until the second pumping stage 2*b* if a purge gas is injected continuously into the so-called low-pressure pumping stage 2*a* situated on the suction side 3 for example.

Thus, a gaseous wave front is artificially created that moves in the direction counter to the flow of the pumped gases. This wave front thus makes it possible to evacuate any solid by-products likely to clog the vacuum pump 1 first of all in the last pumping stage 2*e*, then in the second last and so on. The by-products can be evacuated gradually, beginning with the last pumping stage 2*e*, which can make it possible to avoid the successive build-up thereof between the pumping stages or in a silencer generally arranged after the discharge 4, to thus avoid, in certain cases, aggravating the risk of clogging.

Several wave fronts can thus be created simultaneously in the vacuum pump 1. For example, the injection valve 16*e* of the so-called discharge pumping stage 2*e* can be opened simultaneously with the injection valve 16*a* of the so-called low-pressure pumping stage 2*a*. A new wave front begins while a preceding wave front is being completed.

It is understood that by increasing the number of injection valves, the possible choices are multiplied.

In the case of injection members 12*a*-12*e* produced in the form of flow rate controllers that can be controlled by the control device 10, it is also possible to provide for particular pulse amplitudes at each pumping stage 2*a*-2*e*.

Figure 4:
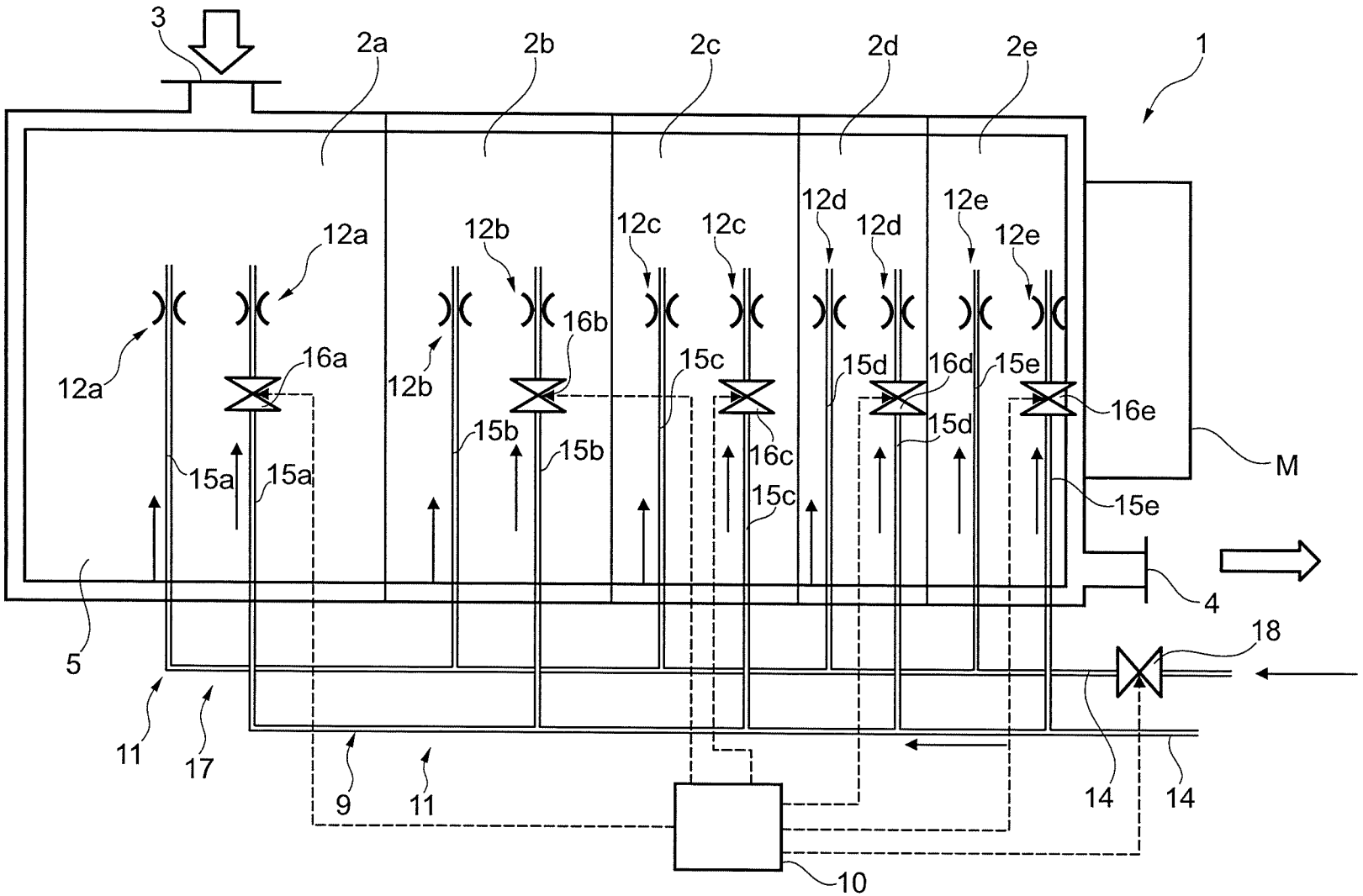
FIG. 4 shows a view similar to FIG. 1 for a third exemplary embodiment.

FIG. 4 shows a third exemplary embodiment.

In this example, the vacuum pump 1 comprises an additional injection device 17.

The additional injection device 17 comprises a distribution manifold 11 for distributing a purge gas in the pumping stages 2*a*-2*e*, an injection member 12*a*-12*e* for each pumping stage 2*a*-2*e* interposed between the distribution manifold 11 and a respective pumping stage 2*a*-2*e* and a controllable continuous injection valve 18 arranged on a branch 14 of the distribution manifold 11 common to the pumping stages 2*a*-2*e*.

The controllable continuous injection valve 18 is, for example, a solenoid valve such as an electromagnetic or piezoelectric solenoid valve. This valve, for example, has an on or off control.

The control device 10 is also configured to control the opening of the at least one continuous injection valve 18 to inject a purge gas continuously into at least one pumping stage 2*a*-2*e*.

Given that a purge gas flow can be constantly ensured in all the pumping stages 2*a*-2*e* by means of the additional injection device 17, the injection device 9 can comprise only one or a few injection members emerging in the pumping stages 2*a*-2*e* that are attached or not, and cannot comprise injection members and injection valves in all the pumping stages 2*a*-2*e*.

It is also possible, as in the second embodiment, for the injection device 9 to comprise a distribution manifold 11 configured to distribute a purge gas in the pumping stages 2*a*-2*e*, an injection member 12*a*-12*e* for each pumping stage 2*a*-2*e* interposed between the distribution manifold 11 and a respective pumping stage 2*a*-2*e* and an injection valve 16*a*-16*e* for each pumping stage 2*a*-2*e* arranged on a respective bypass 15*a*-15*e* of the distribution manifold 11.

In operation, the opening of the at least one injection valve 16*a*-16*e* is controlled to inject purge gas pulses into at least one pumping stage 2*a*-2*e* and the opening of the at least one continuous injection valve 18 is controlled to inject a purge gas continuously at each pumping stage 2*a*-2*e*.

The flow of the purge gas injected by successive pulses, for example, lies between 10 slm and 120 slm, such as 100 slm, and the flow of the purge gas injected continuously lies for example between 10 slm and 120 slm, such as 50 slm (or 84 $Pa \cdot m^3/s$). The frequency of the pulses is, for example, 0.5 Hz. The duty cycle is, for example, 50%.

Consequently, in addition to the possibilities described for the second embodiment, it is possible here to also ensure a non-nil purge flow between two purge gas pulses in one and the same pumping stage 2*a*-2*e*. A purge can thus be maintained continually in all the stages of the vacuum pump 1 simultaneously with jolts of purge wave fronts.

The invention claimed is:

1. A primary vacuum pump of a dry type, comprising:

a suction and a discharge;

pumping stages mounted in series between the suction and the discharge of the vacuum pump;

two rotors extending in each of the pumping stages, the two rotors being configured to rotate synchronously in a reverse direction to drive a gas to be pumped between the suction and the discharge;

an injection device configured to distribute a purge gas in each of the pumping stages, the injection device comprising:

at least one injection member in each of the pumping stages, and at least one injection valve with an on or an off control configured to be interposed between a purge gas supply source and the at least one injection member in each of the pumping stages;

a control device configured to control opening and closing of the at least one injection valve in each of the pumping stages to inject a purge gas by successive pulses, wherein the control device is configured to control of the opening and closing of the at least one injection valve in all of the pumping stages such that the purge gas is introduced into each of the pumping stages sequentially in a direction of a flow of the gas from the discharge to the suction and then the purge gas is introduced into each of the pumping stages sequentially in a direction of the flow of the gas from the suction to the discharge.

2. The primary vacuum pump according to claim 1, wherein the injection device further comprises:

a distribution manifold configured to distribute the purge gas in each of the pumping stages, and the at least one injection member for said each pumping stage interposed between the distribution manifold and a respective pumping stage.

3. The primary vacuum pump according to claim 2, wherein the injection device further comprises the at least one injection valve for said each pumping stage arranged on a respective bypass of the distribution manifold and configured to distribute the purge gas in a respective pumping stage.

4. The primary vacuum pump according to claim 1, wherein a frequency of the successive pulses is between 0.1 Hz and 5 Hz.

5. The primary vacuum pump according to claim 1, wherein a flow of the purge gas injected by the successive pulses is between 17 $Pa \cdot m^3/s$ and 202 $Pa \cdot m^3/s$.

6. The primary vacuum pump according to claim 1, wherein a ratio of an opening time to a closing time of the at least one injection valve is between 1% and 80%.

7. The primary vacuum pump according to claim 1, further comprising:

a distribution manifold configured to distribute the purge gas in each of the pumping stages;

the at least one injection member for said each pumping stage interposed between the distribution manifold and a respective pumping stage;

a controllable continuous injection valve arranged on a branch of the distribution manifold common to each of the pumping stages, wherein the control device is further configured to control opening of the at least one continuous injection valve to inject the purge gas continuously into each of the pumping stages.

8. A method for controlling an injection of a purge gas into a primary vacuum pump of dry type according to claim 1, wherein the opening of the at least one injection valve is controlled to:

inject the purge gas by the successive pulses into each of the pumping stages.

9. The method according to claim 8, wherein the injection device of the primary vacuum pump further comprises the at least one injection valve for said each pumping stage arranged on a respective bypass of a distribution manifold and configured to distribute the purge gas in a respective pumping stage, and wherein at least two purge gas pulse durations are different in two of the pumping stages.

10. The method according to claim 8, wherein the injection device of the primary vacuum pump further comprises the at least one injection valve for said each pumping stage arranged on a respective bypass of a distribution manifold and configured to distribute the purge gas in a respective pumping stage, and wherein a continuous flow of purge gas is injected into the at least one pumping stage by controlling the at least one injection valve continually in open mode.

* * * * *